US010533824B2

(12) United States Patent
Lam

(10) Patent No.: US 10,533,824 B2
(45) Date of Patent: Jan. 14, 2020

(54) DEVICE ADAPTED FOR TOY LAUNCHER PROJECTILE AND TOY GUN

(71) Applicant: CHAP MEI PLASTIC TOYS MANUFACTORY LIMITED, Hong Kong (CN)

(72) Inventor: Hing Fung Simon Lam, Hong Kong (CN)

(73) Assignee: CHAP MEI PLASTIC TOYS MANUFACTORY LIMITED, Hong Kong (CN)

( * ) Notice: Subject to any disclaimer, the term of this patent is extended or adjusted under 35 U.S.C. 154(b) by 0 days.

(21) Appl. No.: 15/393,597

(22) Filed: Dec. 29, 2016

(65) Prior Publication Data

US 2017/0191790 A1 Jul. 6, 2017

(30) Foreign Application Priority Data

Dec. 30, 2015 (HK) ..... 15112871

(51) Int. Cl.

| | |
|---|---|
| ***F41B 11/89*** | (2013.01) |
| ***F41B 11/646*** | (2013.01) |
| ***F41A 17/56*** | (2006.01) |
| ***F41B 11/643*** | (2013.01) |
| ***F41B 11/645*** | (2013.01) |
| ***F41B 11/54*** | (2013.01) |
| ***F41B 11/641*** | (2013.01) |

(52) U.S. Cl.

CPC ..... *F41B 11/89* (2013.01); *F41A 17/56* (2013.01); *F41B 11/54* (2013.01); *F41B 11/641* (2013.01); *F41B 11/643* (2013.01); *F41B 11/645* (2013.01); *F41B 11/646* (2013.01)

(58) Field of Classification Search

CPC ... F41B 11/54; F41B 11/64–648; F41B 11/89; F41B 7/00; F41B 7/006; F41B 7/08; F41A 17/56

USPC ..... 124/48, 59, 79–80

See application file for complete search history.

(56) References Cited

U.S. PATENT DOCUMENTS

| | | | | |
|---|---|---|---|---|
| 3,895,459 A * | 7/1975 | Morrison | A63F 9/14 | 446/430 |
| 4,834,059 A * | 5/1989 | Moorhouse | F41B 11/50 | 124/31 |
| 5,515,837 A * | 5/1996 | Nin | F41B 11/723 | 124/59 |

(Continued)

*Primary Examiner* — Stephen Johnson
*Assistant Examiner* — Benjamin S Gomberg
(74) *Attorney, Agent, or Firm* — Muncy, Geissler, Olds & Lowe, P.C.

(57) ABSTRACT

A toy projective launcher includes a launching tube; a catapulting cavity located at an end portion of the launching tube; a trigger seat located between the launching tube and the catapulting cavity; a catapulting rod, including a transverse rod having a head end extending into the catapulting cavity and a vertical rod connecting with a tail end of the transverse rod, the transverse rod being equipped with a resistance matching member; a push-pull rod, one end being equipped with a push-pull portion, the push-pull portion being contacted with the vertical rod of the catapulting rod; a catapulting rod stopper, equipped with a first through hole for the transverse rod of the catapulting rod to pass through; and a trigger connecting rod, a first end being connected with the trigger seat, and a second end being contacted with the catapulting stopper.

10 Claims, 3 Drawing Sheets

(56) References Cited

U.S. PATENT DOCUMENTS

| | | | | | |
|---|---|---|---|---|---|
| 5,605,140 | A * | 2/1997 | Griffin | F41B 11/642 | 124/59 |
| 5,711,285 | A * | 1/1998 | Stewart | F41B 11/642 | 124/67 |
| 5,724,954 | A * | 3/1998 | Smith | F41B 11/642 | 124/66 |
| 5,975,068 | A * | 11/1999 | Halter | F41B 11/642 | 124/37 |
| 6,523,535 | B2 * | 2/2003 | Rehkemper | F14B 4/00 | 124/78 |
| 7,287,526 | B1 * | 10/2007 | Bligh | F41B 11/643 | 124/63 |
| 7,677,235 | B2 * | 3/2010 | Zimmerman | F41B 11/646 | 102/502 |
| 8,387,605 | B2 * | 3/2013 | Brown | F41C 7/02 | 124/27 |
| 8,720,426 | B2 * | 5/2014 | Hadley | F41B 11/51 | 124/66 |
| 8,820,305 | B2 * | 9/2014 | Victor | F41B 7/08 | 124/27 |
| 8,875,690 | B2 * | 11/2014 | Chor-Ming | F41A 9/27 | 124/45 |
| 9,097,484 | B2 * | 8/2015 | Poirier | F41B 7/08 | |
| 9,222,748 | B2 * | 12/2015 | Macy | F41B 11/643 | |
| 9,500,432 | B2 * | 11/2016 | Chia | F41B 11/70 | |
| 9,513,075 | B2 * | 12/2016 | Lallier | F41A 9/73 | |
| 2010/0147277 | A1 * | 6/2010 | Zimmerman | F41A 9/25 | 124/56 |
| 2012/0125304 | A1 * | 5/2012 | Brooks | F41B 7/003 | 124/52 |

* cited by examiner

DEVICE ADAPTED FOR TOY LAUNCHER PROJECTILE AND TOY GUN

TECHNICAL FIELD

The present invention relates to a toy, and more particularly, to a toy device adapted for launching a projectile and a toy gun.

BACKGROUND

In the growth of children, toys will bring them many beneficial experiences and happiness. If the toys, however, are of low quality, then no happiness, or even harm will be brought to the children. The safety problem of catapulting toys is particularly concerned. In the prior art, enhancing the strength of a projectile (enabling the projectile to pass through a tensile test)/shortening a stroke or connecting with a safety valve from a launching cylinder to control exhaust through the projectile is usually used in terms of the safety problems of catapulting toys.

SUMMARY OF THE INVENTION

The features and advantages of the present invention are partially described in the description hereinafter, or are obvious from the description, or are studied through the practice of the present invention.

In order to overcome the problems of the prior art, the present invention provides a toy projectile launching device adapted for launching a projectile and a toy gun, improving the energy-stored launcher in a mechanical structure to prevent from catapulting an incompletely inserted projectile.

According to one aspect, the present invention provides a toy projectile launching device adapted for launching a projectile, comprising a launching tube, used for receiving a projectile; a catapulting cavity, located at an end portion of the launching tube for catapulting the projectile out of the launching tube; a trigger seat, located between the launching tube and the catapulting cavity, a surface of the trigger seat facing toward the launching tube and being equipped with a projection for contacting a bottom of a projectile; a catapulting rod, comprising a longitudinal rod having a head end extending into the catapulting cavity and a vertical rod connecting with a tail end of the longitudinal rod, the longitudinal rod being equipped with a resistance matching member; a push-pull rod having one end equipped with a push-pull portion, the push-pull portion contacting the vertical rod of the catapulting rod; a catapulting rod stopper, equipped with a first through hole for the longitudinal rod of the catapulting rod to pass through, one edge of the first through hole being matched with the resistance matching member in the catapulting rod; and a trigger connecting rod having a first end connected with the trigger seat and a second end contacting the catapulting stopper.

According to one embodiment of the present invention, the resistance matching member is a groove, and an upper edge of the first through hole of the catapulting rod is used for blocking in the groove to fix the catapulting rod.

According to one embodiment of the present invention, a spring is arranged at one end of the catapulting stopper.

According to one embodiment of the present invention, the catapulting stopper is further equipped with a groove or a second through hole for receiving a second end of the trigger connecting rod.

According to one embodiment of the present invention, the second end of the trigger connecting rod is equipped with a boss matched with the groove or the second through hole.

According to one embodiment of the present invention, the trigger connecting rod comprises a first connecting rod and a second connecting rod which are rotatably connected with each other, a first end of the trigger connecting rod is located on the first connecting rod, and a second end is located on the second connecting rod.

According to one embodiment of the present invention, the second connecting rod is equipped with a plurality of installing holes, and a size of the installing hole is greater than a size of a fastener used for inserting in the installing hole.

According to one embodiment of the present invention, the trigger seat comprises a front cover and a substrate connecting rod located at the rear of the front cover for connecting with the trigger connecting rod; the projection is arranged in the substrate connecting rod; and the front end is provided with a through hole for exposing the projection out.

According to one embodiment of the present invention, a side wall at a rear end of the longitudinal rod of the catapulting rod is equipped with a baffle.

According to one embodiment of the present invention, a handheld portion is arranged at one end of the push-pull rod without the push-pull portion.

According to another aspect, the present invention provides a toy gun, comprising the projectile launching device and a driving mechanism, wherein the driving mechanism comprises a pull rod buckle, a projection slope and a rotation shaft.

According to one embodiment of the present invention, the projection slope is contacted with a bottom of a catapulting rod stopper of a catapulting rod sheathed in the projectile launching device for supporting the catapulting rod stopper upwards.

Those having ordinary skill in the art will preferably understand features and contents of these technical solutions by reading the description.

BRIEF DESCRIPTION OF THE DRAWINGS

The present invention will be described in detail with reference to the drawings and in combination with the embodiments hereinafter. The advantages and implementation of the present invention will be more obvious, wherein the contents shown in the drawings are used for explaining and illustrating the present invention merely, but not formed as limitation to the present invention in any sense, in the figure.

DETAILED DESCRIPTION

Figure 1:
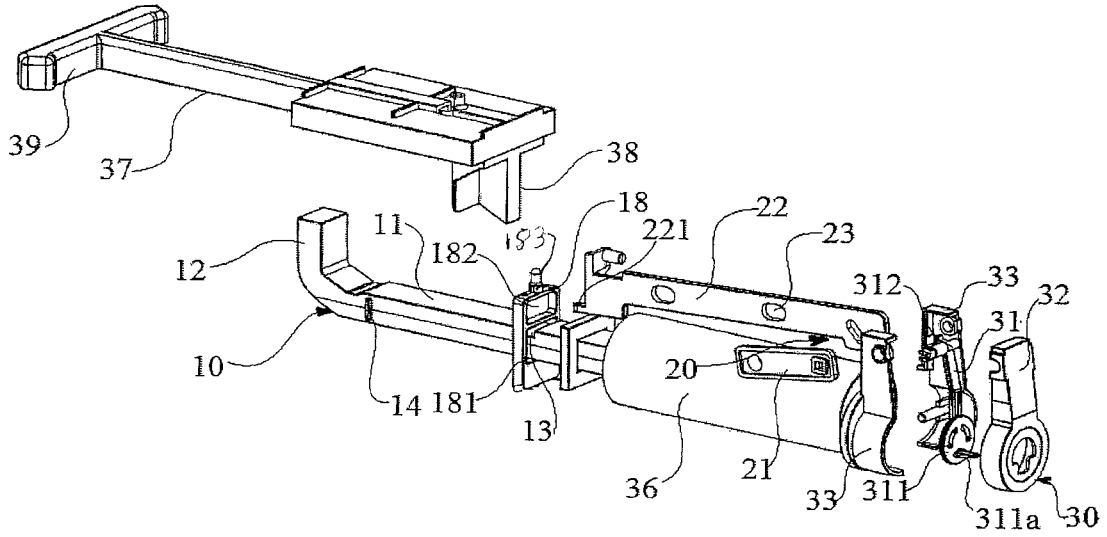
FIG. 1 is an exploded schematic diagram of a toy projectile launching device adapted for launching a projectile, according to an embodiment of the present invention.

As shown in FIG. 1, the present invention provides a toy projective launching device adapted for launching a projectile, comprising a launching tube 25 for receiving a projectile; a catapulting cavity 36, located at an end portion of the launching tube 25 for catapulting the projectile out of the launching tube; a trigger seat 30, located between the launching tube 25 and the catapulting cavity 36, a surface of the trigger seat facing toward the launching tube and being equipped with a projection 311*a* for contacting with a bottom of a projectile; a catapulting rod 10, comprising a longitudinal rod 11 having a head end extending into the catapulting cavity and a vertical rod 12 connecting with a tail end of the longitudinal rod, the longitudinal rod 11 being equipped with a resistance matching member 13; a push-pull rod 37 having one end equipped with a push-pull portion 38, the push-pull portion 38 contacting the vertical rod 12 of the catapulting rod; a catapulting rod stopper 18, equipped with a first through hole 181 for the longitudinal rod of the catapulting rod to pass through, one edge of the first through hole 181 being matched with the resistance matching member 13 in the catapulting rod; and a trigger connecting rod 20, a first end being connected with the trigger seat 30, and a second end being contacted with the catapulting rod stopper 18.

In the present invention, the trigger seat 30 comprises a front cover 32 and a substrate connecting rod 31 located at the rear of the front cover for connecting with the trigger connecting rod. The projection 311*a* is connected to the substrate connecting rod 31 and the front end 32 is provided with a hole through which the projection 311*a* extends. The trigger seat 30 further comprises two side covers 33. The two side covers 33 are located at the rear of the front cover 32 and are installed with the front cover together. The substrate connecting rod 31 is located in a space consisting of the front cover 32 and the two side covers 33. The substrate connecting rod 31 comprises a chassis 311 and a transverse shaft 312 that are connected with each other. The chassis is aligned with the through hole of the front cover, the projection 311*a* is arranged in the chassis 311. When a bottom of the projectile is contacted with the front cover 32, the projectile can contact with the projection 311*a* if the projectile is completely inserted thereby driving a transverse shaft 312 connected therewith. The trigger connecting rod 20 is fixed on the transverse shaft 312 of the substrate connecting rod 31, so that the motion of the transverse shaft 312 can drive the trigger connecting rod to move.

In this embodiment, the trigger connecting rod 20 comprises a first connecting rod 21 and a second connecting rod 22, which are rotatably connected with each other. The first connecting rod 21 is connected with the trigger seat. That is, a first end of the trigger connecting rod 20 is located on the first connecting rod 21, while a second end thereof is located on the second connecting rod 22. In addition, the first connecting rod 22 is further equipped with a plurality of installing holes 23. The installing hole 23 is larger than a fastener 24 for inserting into the installing hole.

The resistance matching member 13 located on the catapulting rod 10 can be a groove, and an upper edge of the first hole 181 of the catapulting rod stopper 18 is used for blocking in the groove to fix the catapulting rod 10. The catapulting stopper 18 is further equipped with a groove 182 for a second end of the trigger connecting rod 20 to be inserted into. To be specific, the second end of the trigger connecting rod 20 is equipped with a boss 221 matched with the groove 182. When the trigger seat 30 is triggered, the trigger connecting rod 20 is pushed to pull the second connecting rod 22 out toward a direction of the trigger seat, so that the boss 221 of the second connecting rod 22 leaves the groove 182 of the catapulting rod stopper. In addition, one end of the catapulting rod stopper 18, such as one close to the groove 182, is further equipped with a spring 183 for enabling the catapulting rod stopper to move along a direction of the pull rod buckle 41 in a reciprocating manner. In another embodiment of the present invention, the groove 182 can be replaced by a second through hole.

A baffle 14 is arranged at a side wall close to a tail end of the longitudinal rod 11 of the catapulting rod for contacting with two side edges of the catapulting rod stopper 18, thereby avoiding a too-long portion of the longitudinal rod 11 of the catapulting rod extending into the catapulting cavity 36. A hand-held portion 39 is arranged at one end of the push-pull rod 37 not equipped with the push-pull portion. The hand-held portion 39 is a transverse rod, a center of which is connected with the push-pull rod 37. A user can pull the push-pull rod along a direction away from the trigger seat through the hand-held portion 39, which drives the catapulting rod to move along the direction away from the trigger seat as well.

Figure 2:
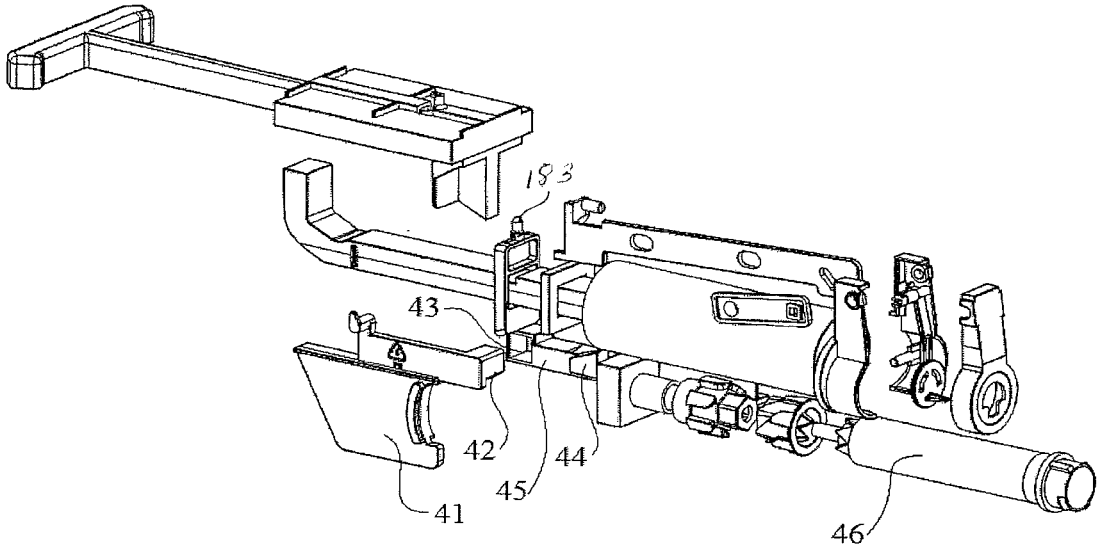
FIG. 2 is an exploded schematic diagram of toy projectile launching device adapted for launching a projectile and a driving mechanism of an embodiment, according to an embodiment of the present invention.
Figure 3:
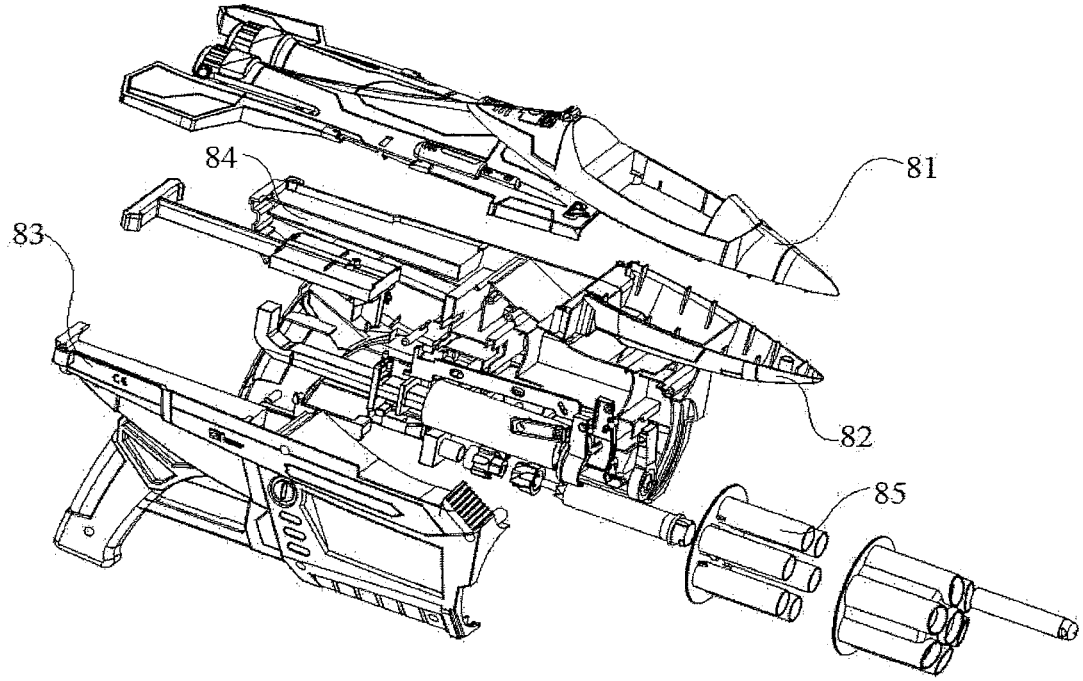
FIG. 3 is an exploded schematic diagram of a toy gun, according to an embodiment of the present invention.

As shown in FIG. 2 and FIG. 3, the present invention further provides a toy gun, comprising the projectile launching device and a driving mechanism, wherein the driving mechanism comprises a pull rod buckle 41, a projection slope 44 and a rotation shaft 46 which are connected in succession. To be specific, the pull rod buckle 41 is provided with a projection block 42. A projection slope 44 is arranged in a connecting rod 45. One end of the connecting rod 45 is provided with a concave hole 43 matched with the projection block 42, while the other end thereof is connected with a rotation shaft 46. The rotation shaft 46 can be sheathed with a bullet magazine 85.

When the pull rod buckle 41 is fastened, the projection block 42 located in the concave hole 43 drives the connecting rod 45 to move so that the projection slope 44 has a certain displacement to contact with a bottom of the catapulting rod stopper 18 of the catapulting rod sheathed in the device adapted for toy launcher projectile, and to support the catapulting rod stopper. In this way, the catapulting rod can move in the catapulting cavity to catapult the projectile.

In addition, the toy gun further comprises a shell. The shell comprises an upper cover 81, a first side cover 82, and a second side cover 83. The first side cover 82 is provided with a chute 84, for the push-pull rod of the device adapted for toy launcher projectile to slide.

Figure 4:
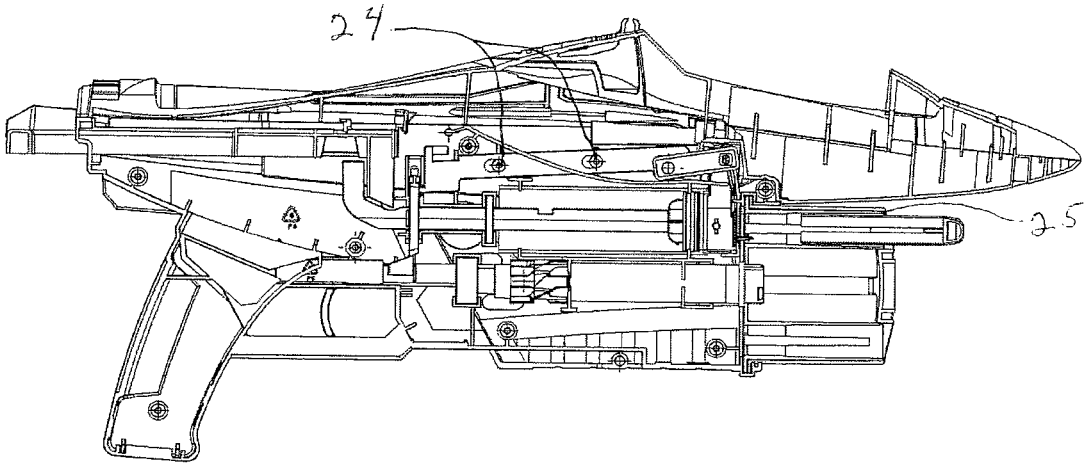
FIG. 4 is a status schematic diagram of a toy gun before putting in a projectile, according to an embodiment of the present invention.
Figure 5:
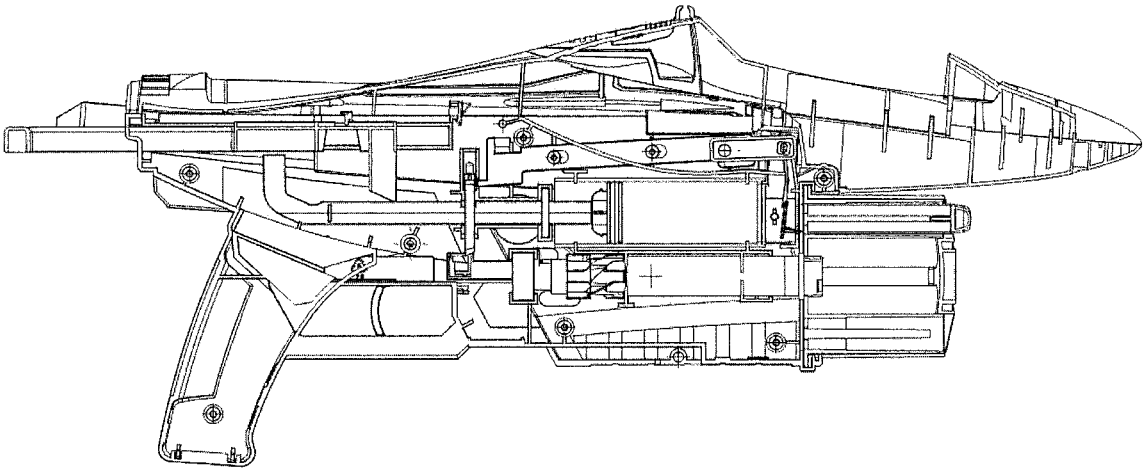
FIG. 5 is a status schematic diagram of a toy gun after putting in a projectile, according to an embodiment of the present invention.
Figure 6:
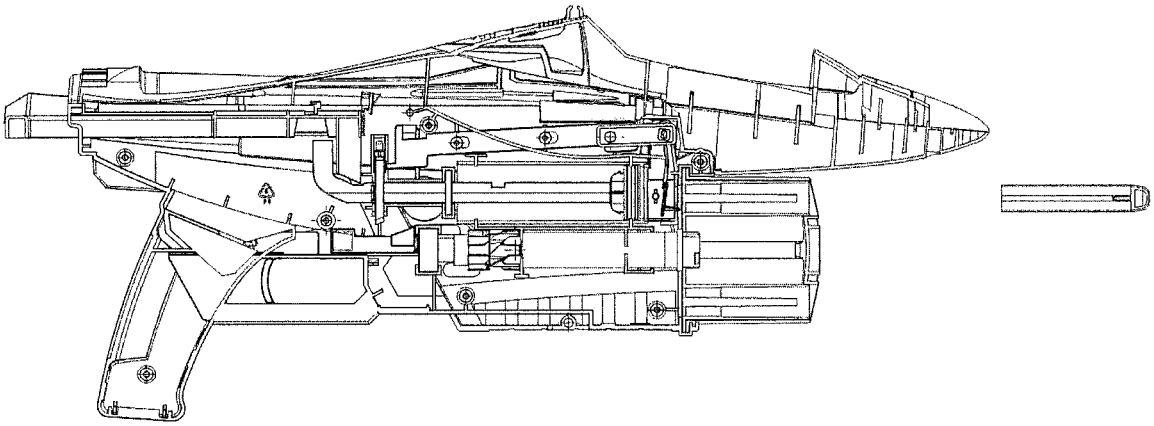
FIG. 6 is a status schematic diagram of a toy gun after catapulting out a projectile, according to an embodiment of the present invention.

Referring to FIG. 4 to FIG. 6, the baffle in the launcher rod is contacted with the catapulting rod stopper as soon as the projectile in FIG. 4 enters into the launching tube. The projection 311*a* of the chassis of the substrate connecting rod protrudes out of the through hole of the front cover 32, and the boss 221 of the second connecting rod is extended into the groove 182 of the catapulting rod stopper, so that the catapulting rod stopper stays in the catapulting rod and is prevented from moving along a direction of the pull rod buckle 41. In FIG. 5, the projectile triggers the trigger seat to drive the connecting rod to push the first connecting rod 21 so that the second connecting rod moves along a direction of the trigger seat, and the boss 221 of the second connecting rod leaves from the groove 182 of the catapulting rod stopper. The user pulls the push-pull rod 37 so that the push-pull portion 38 of the push-pull rod to drive the vertical rod of catapulting rod, and pushes the catapulting rod along a direction away from the catapulting cavity so that the catapulting rod is formed in an energy storage state through the pushing of an energy storage spring until the catapulting rod stopper is fallen down and blocked into the groove in the catapulting rod, the catapulting rod is locked by the catapulting rod stopper, and the push-pull rod is returned to its original position at this moment. In FIG. 6, the user fastens the push-pull buckle, which drives the connecting rod 45 to move to drive the projection slope 44 contacted with the bottom of the catapulting rod stopper 18 to move and support the catapulting rod stopper upwards, so that the catapulting rod stopper leaves from the groove of the catapulting rod to release the catapulting rod, the catapulting rod moves forward into the catapulting cavity and generates a compressed gas in the catapulting cavity 36 from which the compressed gas passes from the through hole of the front cover 32 to the bottom of the projectile to catapult the projectile out.

In another embodiment, the baffle in the catapulting rod is contacted with the catapulting rod stopper before the complete insertion of the projectile placed into the launching tube, the projection 311*a* of the chassis of the substrate connecting rod protrudes out of the through hole of the front cover 32, the boss 211 of the second connecting rod extends into the groove 182 of the catapulting rod stopper so that the catapulting rod stopper stays on the catapulting rod and is prevented from moving downwards. As the bottom of the incompletely inserted projectile fails to contact with the projection of the chassis after the incompletely inserted projectile is entered into the launching tube, the trigger connecting rod will not drive the second connecting rod to move in any way under the precise that the trigger seat fails to be triggered, at this moment the boss 221 of the second connecting rod is still held in the groove of the catapulting rod stopper so that the catapulting rod stopping rod fails to move downward (a direction of the pull rod buckle 41). The user pulls the push-pull rod 37 so that the push-pull portion 38 of the push-pull rod drives the vertical rod of the catapulting rod to push the catapulting rod toward the direction away from the catapulting cavity. As the catapulting rod stopper fails to move downward (a direction of the pull rod buckle 41), the catapulting rod stopper fails to enter into the groove in the catapulting rod, so that the catapulting rod fails to be locked by the catapulting rod stopper, so the catapulting rod is returned to the original position under the push of the energy storage spring. At this moment, even if the user fastens the pull rod buckle, the pull rod buckle drives the connecting rod 45 to move, which does not generate any trigger action on the bottom of the catapulting rod stopper, so that the projectile cannot be catapulted.

The invention aims at addressing safety problems of catapulting toys and improves the energy-stored launcher in a mechanical structure to prevent from catapulting the incomplete projectile. Before placing the projectile in the launching tube, no hollow sound is made even if a pull rod buckle is tightened and the catapulting rod is still not in a catapulting state in case of incomplete placement of the projectile.

The preferred embodiment of the present invention is described with reference to the drawings above. Various modification solutions may be made by those skilled in the art without departing from the scope and essence of the present invention to achieve the present invention. For example, features illustrated or described by part of one embodiment may be used for the other embodiment to obtain another embodiment. The above is the better feasible embodiment of the present invention merely, but is not intended to limit the right scope of the present invention. Any equivalent changes made by the description and drawing contents of the present invention shall all fall within the right scope of the present invention.

The invention claimed is:

1. A projectile launching device, comprising:

a launching tube for receiving a projectile;

a cavity, located at an end portion of the launching tube for compressing air to catapult the projectile from the launching tube;

a seat, located between the launching tube and the cavity, a surface of the seat facing toward the launching tube, the seat including a front cover and a chassis carrying a projection for contacting a bottom of the projectile to sense when the projectile is positioned in the launching tube causing the projection to move rearwardly, the front cover having a hole through which the projection extends;

a catapulting rod, comprising a longitudinal rod having a head end extending into the cavity to cause the air to be compressed when the catapulting rod is moved toward the launching tube and a vertical rod connected to a tail end of the longitudinal rod, the longitudinal rod being equipped with a holding member;

a first rod, mechanically separate from the catapulting rod, having one end equipped with a first portion, the first portion contacting the vertical rod of the catapulting rod to pull the catapulting rod back to a cocked position;

a catapulting rod stopper equipped with a first through hole for the longitudinal rod of the catapulting rod to pass through, one edge of the first through hole being matched with the holding member in the catapulting rod to hold the catapulting rod in the cocked position;

a rod assembly having a first end connected with the seat and a second end connected with the catapulting rod stopper, so as to prevent the catapulting rod from moving toward the launching tube unless the projectile is positioned in the launching tube; and the rod assembly including a third rod, a fourth rod and a fifth rod; the fifth rod being connected to the chassis, so as to rotate when the projection moves rearwardly, sensing the projectile; the third rod being rotatively connected to the fifth rod, so as to rotate when the fifth rod rotates in response to the projection moving rearwardly when sensing the projectile; the fourth rod being connected to the third rod so as to move forwardly when the third rod rotates, the fourth rod having a boss at the second end of the rod assembly, the boss being disconnected from the catapulting rod stopper when the fourth rod moves forwardly when the projectile is sensed by the projection.

2. The projectile launching device according to claim 1, wherein the holding member is a groove, and the one edge of the first through hole of the catapulting rod stopper is capable of being inserted into the groove to hold the catapulting rod in the cocked position.

3. The projectile launching device according to claim 1, wherein a spring is arranged at one end of the catapulting rod stopper.

4. The projectile launching device according to claim 1, wherein the catapulting rod stopper is further equipped with a groove or a second through hole for receiving the boss at the second end of the rod assembly.

5. The projectile launching device according to claim 4, wherein the boss is matched with the groove or the second through hole.

6. The projectile launching device according to claim 1, wherein the fourth rod is equipped with a plurality of holes, and a diameter of each of the plurality of holes is larger than a diameter of a fastener inserted in one of the plurality of holes, the third rod being connected to the fourth rod by way of the fastener.

7. The projectile launching device according to claim 1, wherein a side wall at the tail end of the longitudinal rod of the catapulting rod is equipped with a baffle for limiting travel of the catapulting rod.

8. The projectile launching device according to claim 1, wherein a handheld portion is arranged at another end of the first rod without the first portion.

9. A toy gun, comprising:

the projectile launching device according to claim 1; and a driving mechanism, wherein the driving mechanism comprises a pull rod buckle, a projection slope and a rotation shaft which are connected successively.

10. The toy gun according to claim 9, wherein the projection slope contacts a bottom of the catapulting rod stopper for supporting the catapulting rod stopper.

* * * * *